US008767987B2

(12) United States Patent
Fretz

(10) Patent No.: US 8,767,987 B2
(45) Date of Patent: Jul. 1, 2014

(54) EAR CONTACT PRESSURE WAVE HEARING AID SWITCH

(75) Inventor: Robert J. Fretz, Maplewood, MN (US)

(73) Assignee: IntriCon Corporation, Arden Hills, MN (US)

( * ) Notice: Subject to any disclaimer, the term of this patent is extended or adjusted under 35 U.S.C. 154(b) by 681 days.

(21) Appl. No.: 13/030,828

(22) Filed: Feb. 18, 2011

(65) Prior Publication Data

US 2011/0142269 A1 Jun. 16, 2011

Related U.S. Application Data

(63) Continuation-in-part of application No. 12/539,702, filed on Aug. 12, 2009, now Pat. No. 8,358,797.

(60) Provisional application No. 61/088,033, filed on Aug. 12, 2008.

(51) Int. Cl.
*H04R 25/00* (2006.01)

(52) U.S. Cl.
USPC ..... 381/314; 381/329; 381/312

(58) Field of Classification Search
CPC ..... H04R 2460/17; H04R 2225/023; H04R 2225/43; H04R 2225/61; H04R 25/30; H04R 25/50; H04R 25/65; H04R 25/70; H04R 25/356; H04R 25/453; H04R 25/505; H04R 25/625; A61B 5/12; A61B 5/121
USPC ..... 381/312–321, 328, 329, 331, 60, 83, 93
See application file for complete search history.

(56) References Cited

U.S. PATENT DOCUMENTS

| | | | | |
|---|---|---|---|---|
| 3,970,987 | A | 7/1976 | Kolm | |
| 5,493,618 | A | 2/1996 | Stevens et al. | |
| 5,615,271 | A | 3/1997 | Stevens et al. | |
| 5,636,285 | A * | 6/1997 | Sauer | 381/314 |
| 5,659,621 | A * | 8/1997 | Newton | 381/312 |
| 6,173,063 | B1 * | 1/2001 | Melanson | 381/318 |
| 6,434,247 | B1 * | 8/2002 | Kates et al. | 381/312 |
| 6,498,858 | B2 * | 12/2002 | Kates | 381/318 |
| 6,748,089 | B1 * | 6/2004 | Harris et al. | 381/107 |
| 7,013,015 | B2 * | 3/2006 | Hohmann et al. | 381/318 |
| 7,197,152 | B2 * | 3/2007 | Miller et al. | 381/326 |
| 7,519,193 | B2 * | 4/2009 | Fretz | 381/312 |
| 7,639,827 | B2 | 12/2009 | Bachler | |
| 7,809,150 | B2 * | 10/2010 | Natarajan et al. | 381/318 |
| 8,116,473 | B2 * | 2/2012 | Salvetti et al. | 381/71.11 |
| 8,199,948 | B2 * | 6/2012 | Theverapperuma | 381/318 |
| 2002/0067838 | A1 | 6/2002 | Kindred et al. | |
| 2004/0125966 | A1 * | 7/2004 | Weidner | 381/96 |
| 2005/0078842 | A1 | 4/2005 | Vonlanthen et al. | |
| 2007/0248237 | A1 | 10/2007 | Bren et al. | |
| 2008/0123885 | A1 | 5/2008 | Weidner | |

* cited by examiner

*Primary Examiner* — Xu Mei
(74) *Attorney, Agent, or Firm* — Shewchuk IP Services, LLC; Jeffrey D. Shewchuk

(57) ABSTRACT

A hearing aid switch utilizes pressure/sound clues from a filtered input signal to enable actuation initiated by a user by a signature hand movement relative to a wearer's ear. The preferred signature hand movement involves patting on the ear meatus at least one time to generate a compression wave commonly thought of as a soft "clap" or "pop". A digital signal processor analyzes the signal looking for a negative pulse, a positive pulse, and dissipation of the hand generated signal.

21 Claims, 13 Drawing Sheets

EAR CONTACT PRESSURE WAVE HEARING AID SWITCH

CROSS-REFERENCE TO RELATED APPLICATION(S)

The present application is a continuation-in-part of U.S. application Ser. No. 12/539,702 entitled SWITCH FOR A HEARING AID, filed Aug. 12, 2009, which is based on and claims the benefit of U.S. provisional patent application Ser. No. 61/088,033, filed Aug. 12, 2008. The contents of both U.S. application Ser. No. 12/539,702 and U.S. provisional patent application Ser. No. 61/088,033 are hereby incorporated by reference in entirety.

BACKGROUND OF THE INVENTION

The present invention relates to hearing aids. In particular, the present invention pertains to switches for changing settings on a hearing aid having a digital signal processor ("DSP") for processing the microphone sensed signal.

Hearing aids are electrical devices having a microphone to receive sound and convert the sound waves into an electrical signal, some sort of amplification electronics which increase and often modify the electrical signal, and a speaker (commonly called a "receiver" in the hearing aid industry) for converting the amplified output back into sound waves that can be better heard by the user. The electronic circuitry is commonly powered by a replaceable or rechargeable battery. In most modern hearing aids, an analog electrical output from the microphone is converted into a digital representation, and the amplification electronics include a DSP acting on the digital representation of the signal.

Hearing aids have long included settings which can be user-controlled to change the audio response parameters of a hearing aid, generally allowing the user to optimize the hearing aid for different varieties of listening situations. For instance, a first setting may be for normal listening situations, a second setting may be for listening in noisy environments, a third setting may be for listening to music, and a fourth setting may be for use with a telephone. Typically, the user can cycle through these settings (also called parameter sets or programs) using a switch on the hearing aid. Examples of the parameters that are adjusted between the various settings include volume, frequency response shaping, and compression characteristics.

The most common type of switch for cycling through hearing aid settings is a mechanical push button switch. The mechanical switch is usually located either on the body or the faceplate of the hearing aid in a position which the user can touch with a finger while wearing the hearing aid.

Mechanical switches, though simple, normally reliable and fairly low-cost, have their drawbacks. Due to the small size of the push button, the user may not always realize that the button has been pushed. To clearly indicate to the user that the push button has been activated, most hearing aids generate an audible tone. Despite the generated tone, however, most users still have a hard time locating the push button on the hearing aid because the push button is relatively small compared to the user's fingers. This drawback makes hearing aids with a push button hard to operate, especially for elderly users. As hearing aids become smaller and are positioned further in the user's ear canal, manipulation of the mechanical switch becomes more and more difficult for most users.

Additionally, push buttons located on the body or the faceplate of a hearing aid are susceptible to sweat and debris that can lead to switch failure. While switches are normally reliable, they include moving parts that can and do fail. Also, while the push button may be small relative to a user's finger tips, it still adds to the size of the hearing aid, thus making the hearing aid more visible and unattractive. While mechanical switches are relatively low cost, such as on the order of a few dollars, they still do contribute to the overall cost of the product.

Separate from the hearing aid industry, acoustic power-on switches for operating 120 Volt AC, plug-in appliances (lights, televisions, etc.) are well known in the U.S. by virtue of the advertising campaign of Joseph Enterprises for the CLAPPER device. See, for instance, U.S. Pat. Nos. 3,970,987, 5,493,618 and 5,615,271. In the most common CLAPPER device, the user brings his or her hands together in two loud claps, and the sound waves for the claps are received by a microphone and analyzed to assess when a user has intended to turn the appliance on or off.

Similarly, a wide variety of voice-activated switches have arisen which respond to vocal commands. Voice-activated commands have well documented problems in terms of cost, size, processing capabilities and accuracy.

While voice-activated and CLAPPER switches may be useful for appliances and other devices, similar types of switches have not found widespread use in hearing aids. Hearing aid users would often be unwilling to clap twice loudly or speak a command each time the user wants to change settings, including in the wide variety of locations where the hearing aid might be in use (such as during a music concert, in a quiet auditorium, etc.). Moreover, hearing aid users generally desire their hearing aid use to be as inconspicuous as possible. The costs of adding these types of switches to a hearing aid (not only monetary, but also processing/battery costs and size costs) have not been found commercially acceptable.

Several attempts have been made to replace the mechanical hearing aid switch with a processor-based switch based upon the microphone input but which avoids audible actuation. For instance, U.S. Pat. No. 6,748,089 to Harris et al. discloses a hearing aid switch which is intended to be actuated by the user placing his or her hand in a cupped position over the ear to attenuate the incoming audio signal. This solution has not found marketplace acceptance, likely due to its reliability. Audio signals witnessed by hearing aids naturally change amplitude on a moment to moment basis. It is very difficult to distinguish in a hearing aid processor when such amplitude changes occur due to hand placement over the ear from when such amplitude changes occur due to signal source variations.

As another example, U.S. Pat. No. 7,639,827 to Bachler discloses a hearing aid switch which is intended to be actuated by the user again placing his or her hand in a cupped position over the ear, this time to drive the hearing aid amplification circuit into an unstable, oscillation (feedback) condition. However, unstable oscillation often causes a loud whistling tone in hearing aids which users seek to avoid. Further, most users have many natural gestures and hand movements which place their hands adjacent their ears, and also place other items (telephones, hats, etc.) adjacent their ears. Additional complications arise in that users have differently shaped ears and different hearing aid placements (microphone locations) in their ears, meaning that the microphone response to a given input is not identical from user to user both located in the same room.

A good hearing aid switch should both avoid false positives, i.e., switching when the user has not intended to initiate the switch, and avoid false negatives, i.e., not recognizing each time the user has attempted to initiate the switching action. Until hearing aids are developed which can silently sense the brain waves of the user to determine when the user desires a switch between settings, better solutions are needed.

BRIEF SUMMARY OF THE INVENTION

The present invention is a switch actuated by a user by hand movement relative to a wearer's ear. The switch utilizes pressure/sound clues from a filtered input signal. Most importantly, the pressure/sound clues are related to a signature hand movement relative to the user's ear. The preferred signature hand movement involves cupping of the hand and patting the ear meatus at least one time to generate a compression wave commonly thought of as a soft "clap", "pop" or "thud" due to the way the user's hand mates with ear geometry and seals a volume of air in the concha bowl. Other preferred signature hand movements include two motions, such as placing or wiping the hand over the ear followed by a cupped-hand pat on the ear, or two repeated cupped-hand pats on the ear. The switch algorithm can also utilize feedback cues from coefficients in the internal adaptive feedback FIR filter. The preferred signature hand movements are effectively silent to others in the vicinity of the hearing aid wearer. The signature hand pressure clues can be accurately distinguished from the wide variety of other sounds and pressure waves encountered by the hearing aid in normal use, preventing false positives. The signature hand pressure clues can be accurately identified and reproducibly learned for a wide variety of users, preventing false negatives.

While the above-identified drawing figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
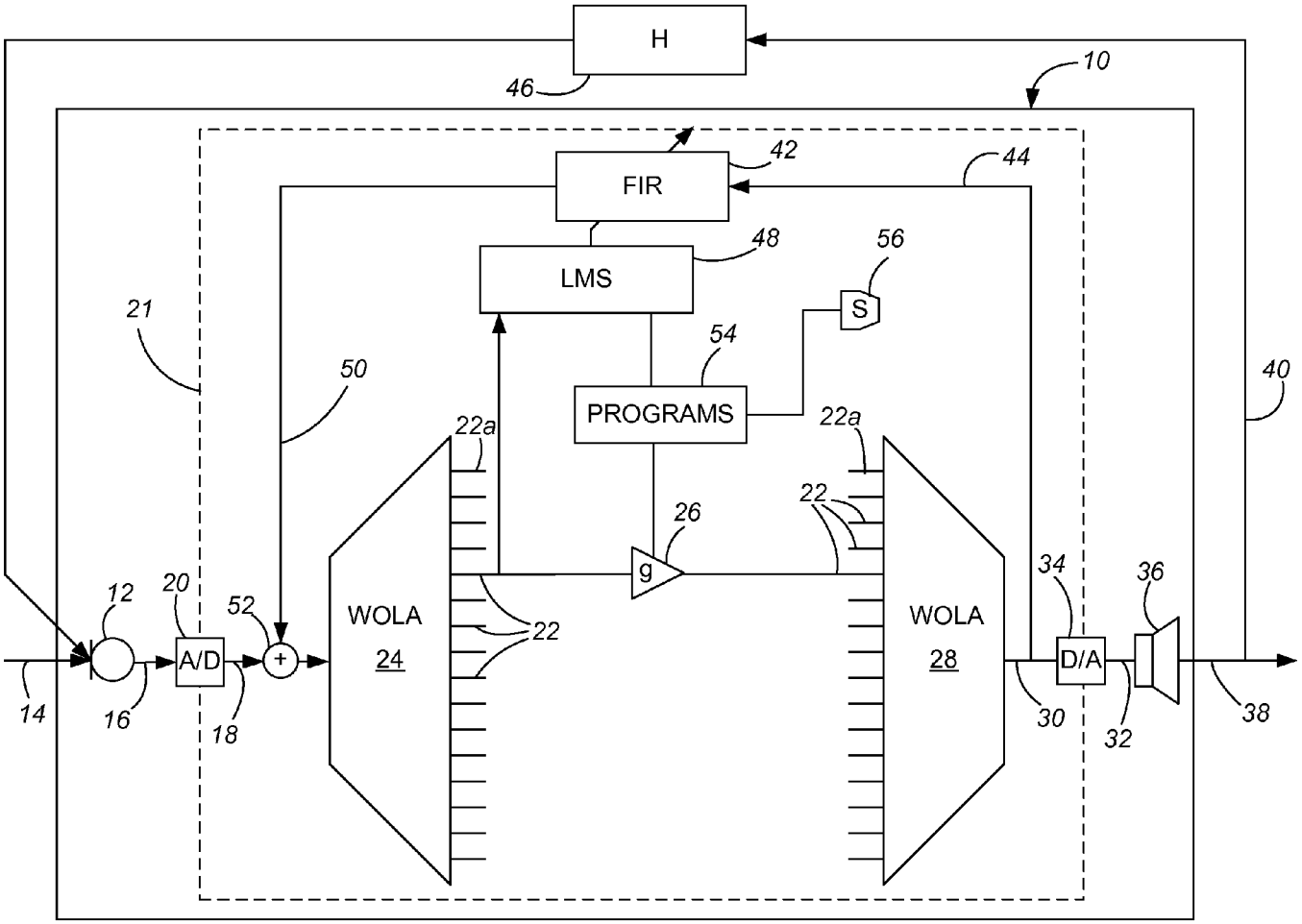
FIG. 1 schematically illustrates the hearing aid of the present invention.

FIG. 1 illustrates a schematic block diagram of a hearing aid device 10. The hearing aid 10 includes a microphone 12 which receives an acoustic/pressure change input signal 14 from the air and converts the input signal 14 into an input electrical signal 16. The electrical signal 16 is converted to a digital signal 18 using an analog-to-digital ("A/D") converter 20, which may be part of a DSP chip 21 or provided in the electrical circuit prior to the DSP chip 21. The digital signal 18 is then separated out into frequency bands 22 (only one of the frequency bands 22 shown in detail) such as with band pass filters or a weighted overlap-add analyzer 24, in the preferred system into sixteen frequency bands 22 covering the 20 to 8,000 Hz range. The DSP 21 processes the digital signal 18, typically amplifying or providing gain to significant parts of the digital signal by a gain amplifier 26 in each band 22. The desired gain and compression in each frequency band 22 (i.e., for each gain amplifier 26) is programmable to match the hearing deficiency profile of a particular wearer as determined during hearing aid fitting. The processed digital signal is recombined in a summer or more preferably a weighted overlap-add synthesizer 28. The combined output 30 is converted into an analog signal 32 with a digital-to-analog ("D/A") converter 34, which analog signal 32 is fed to a receiver 36 to be output as an audible output 38. The audible output 38 is heard by the hearing impaired individual, but also at least some of the output sound 38 may make its way back through the environment to the microphone 12 in what is known as the external acoustic feedback path 40. The DSP 21 may include an internal electrical feedback path 44 and an internal feedback path filter 42, to minimize the generation of feedback oscillation. The internal filter 42 is usually a finite impulse response filter which adapts its response attempt to match and counteract changes occurring in the transfer function 46 of the external acoustic feedback path 40. The coefficients of the FIR filter 42 are controlled by an adaptive controller 48, such as a least mean squared ("LMS") controller, which senses the signal in each frequency band 22 in an attempt to have the feedback FIR filter 42 match the external feedback transfer function and delay 46 at any acoustic conditions. The output 50 of the feedback FIR filter 42 is then subtracted out from the incoming sound signal 14 in a summer 52.

The DSP 21 has parameter settings 54, also known as programs, which assist a hearing aid user in providing different processing characteristics for different types of listening environments and different types of acoustic input 14. The programs 54 may be able to adjust the gain in each frequency band 22 or may adjust other DSP characteristics such as volume, frequency response shaping, noise control and compression characteristics. To change from one set of parameter settings to another set of parameter settings in the hearing aid 10, the hearing aid 10 has some sort of user controlled switch 56.

In most prior art hearing aids, the user controlled switch is a physical push button located either on the body or on the faceplate of the hearing aid. Physical push buttons operate by opening or closing an electrical contact from its normal state.

When the physical push button is pressed, the hearing aid responsively switches to the next available set of parameter settings.

Although the number of parameter settings available in hearing aids varies, a typical hearing aid 10 might have three or four sets of parameter settings. For example, a first set may be for normal listening situations, a second set may be for listening in noisy environments, a third set may be for listening to music, and a fourth set may be for use with a telephone. After a user reaches the last available parameter setting, the next push of the physical push button resets the hearing aid 10 back to the first parameter setting.

While the hearing aid 10 represented in FIG. 1 and described thus far is in common use for many prior art applications, it remains difficult for users to change from one program to another in prior art hearing aids. Part of the difficulty is because the physical push button switch is small in comparison to an adult user's finger size which complicates the process of switching between parameter settings. Also, the physical push button switch adds to the size of the hearing aid device and is considered by some to be unattractive. Other switching alternatives, including capacitive, magnetic and wireless switches have been considered and/or used, but all have space, cost and reliability detriments.

The present invention involves a hearing aid 10 and a method of changing settings 54 on that hearing aid 10. At a minimum, the hearing aid 10 includes a microphone 12 positioned on, around or in the user's ear, and also includes a DSP 21 acting on the microphone signal. It may be possible to locate the microphone 12 behind the user's ear meatus 58 (ear geometry identified in FIG. 2), but more preferably the microphone 12 is located either within the concha bowl 60 or within the ear canal 62 of a user's ear 64.

Figure 2:
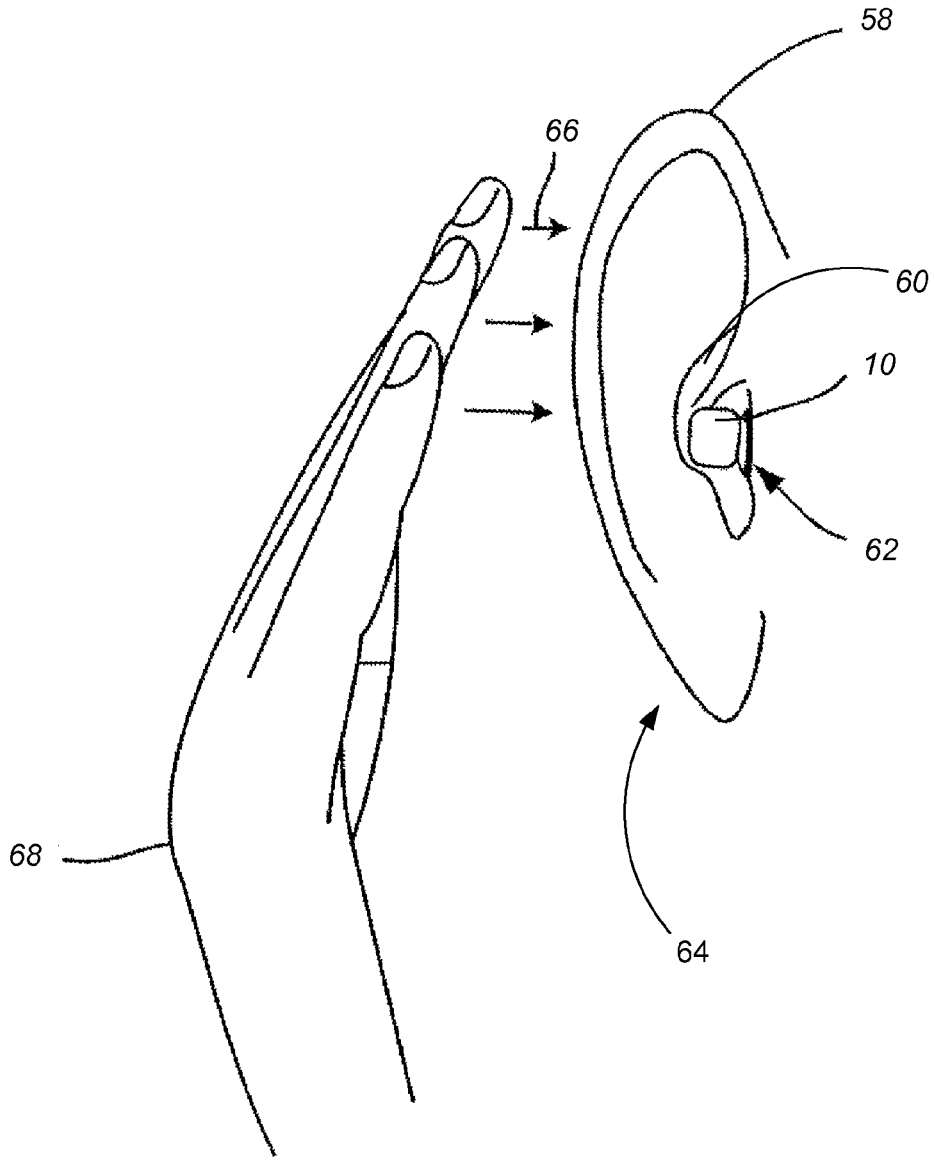
FIG. 2 illustrates a user activating the switch of the present invention by a preferred signature hand motion relative to the user's ear while wearing the hearing aid of FIG. 1.

FIG. 2 depicts the use of an in-the-ear hearing aid 10 using the present invention. To change a parameter setting of the hearing aid 10, the user generates a signature acoustic/pressure wave by a signature hand motion 66. In the preferred embodiment, the signature hand motion 66 includes patting his or her ear 64 with a closed-fingered or cupped hand 68. The objective of the cupped hand patting action is to create a wave of air pressure as the largely-contained volume of air between the user's hand 68 and ear 64 finally compresses during contact of the hand 68 with the user's ear 64. Users, including users of limited dexterity, quickly become adept at creating the low frequency "clap", "thud", "thunk" or "pop" generated upon softly striking their ear 64. Even when the acoustic/pressure wave created by this action cannot be heard by others in the same room as the hearing aid user, the input digital signal created, particularly when low pass filtered, contains a signature response of surprisingly significant magnitude that can be identified and is distinct from virtually all input digital signals witnessed during normal use of the hearing aid 10.

Further understanding of the invention can be obtained by review of the signals of FIGS. 3-10 and 13. As noted earlier, the DSP 21 typically splits the signal 18 into different frequency bands 22, and the present invention preferably makes use of the same frequency bands 22 used by the DSP 21. The signals of shown in the figures are the voltage signal in the lowest frequency band 22*a* of the hearing aid 10 over roughly a 70 millisecond time interval. In the preferred hearing aid 10 and as reported in the figures, the low frequency band signal is for the 0 to 250 Hz band, but the present invention applies to the low frequency band regardless of the roll off frequency, and may possibly apply to other frequency bands to the extent not so limited by the claims. The preferred algorithm is performed once per millisecond, and FIGS. 3-10 and 13 show the signal by connecting the values recorded during each run of the algorithm (one signal value point each millisecond). The preferred 1 kHz frequency of running the algorithm has been found sufficient to identify the signature hand motion 66. The algorithm could alternatively be performed at other rates faster or slower than 1 kHz, up to the sampling rate of the hearing aid 10, which in the preferred embodiment is 16 kHz. The values shown on the time axis shown in FIGS. 3-10 and 13 are in milliseconds, with the event of interest in the signal positioned for best illustration, i.e., the millisecond values shown depend entirely upon when a particular event occurs in time and have no absolute meaning, and only the relative difference between two points on the time axis (i.e., Δ time) has meaning.

The preferred implementation was performed in the APT hearing aid available from IntriCon Corporation of Arden Hills, Minn., which is an in-the-canal (but not sealing the canal 62) hearing aid 10. It is believed that similar results would be achieved over a wide variety of hearing aids, particularly if the hearing aid is an in-the-ear or in-the-canal hearing aid, and that slightly modified results might be obtainable in behind-the-ear implementations.

Figure 3:
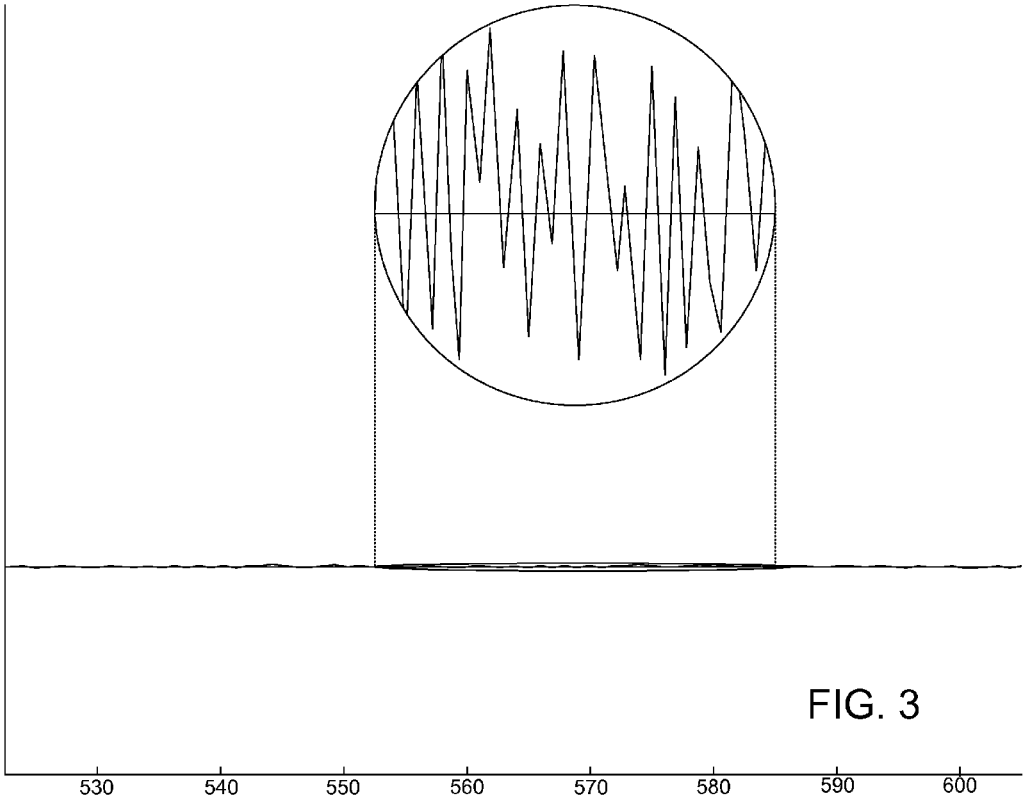
FIG. 3 shows an electrical signal generated from a conversation level speech acoustic input in a low frequency channel in the hearing aid of FIG. 1, with a portion of the signal shown magnified on a different vertical scale.
Figure 4:
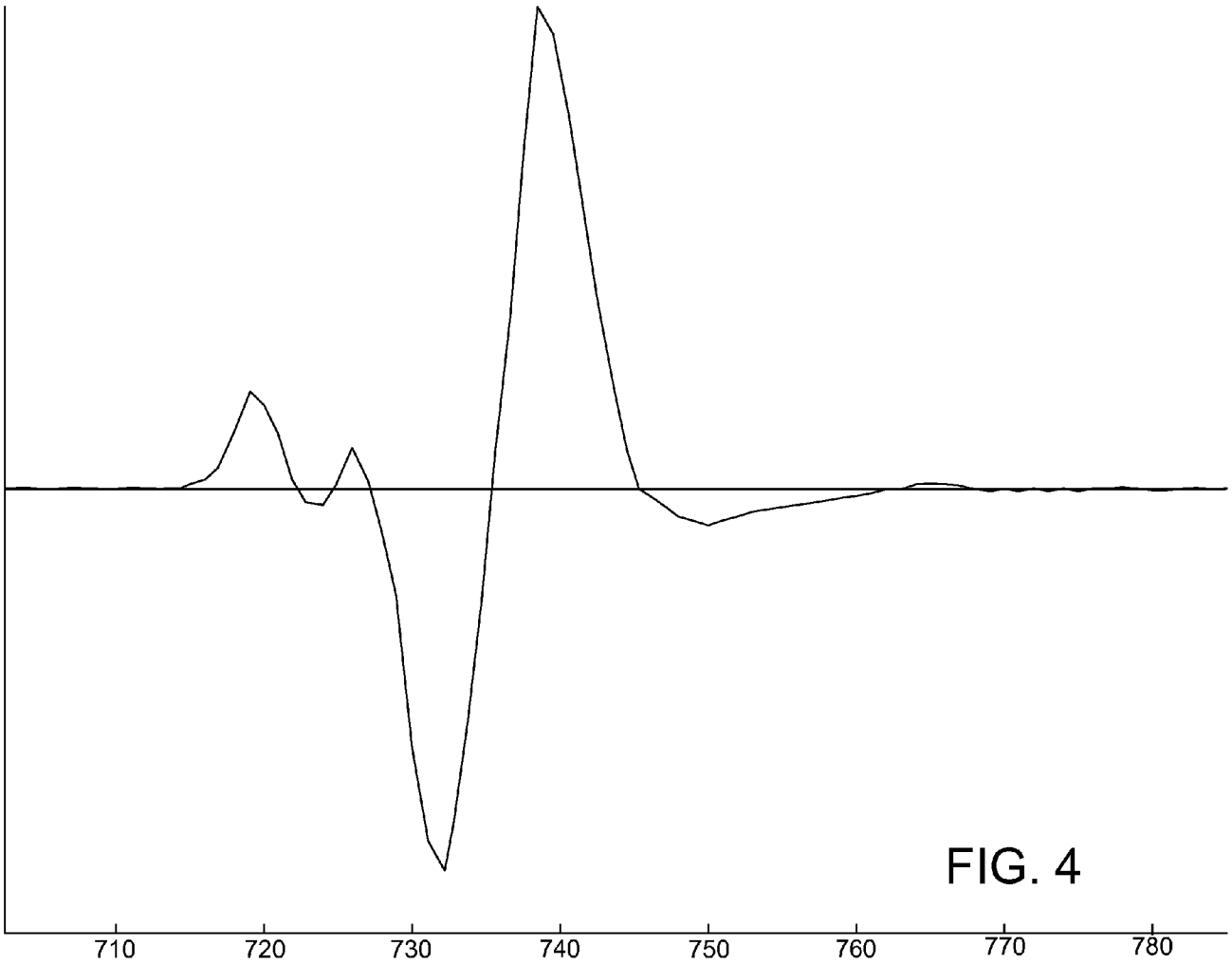
FIGS. 4-7 scale show electrical signals in a low frequency channel in the hearing aid of FIG. 1 generated from a preferred signature hand motion during the speech signal of FIG. 3.
Figure 5:
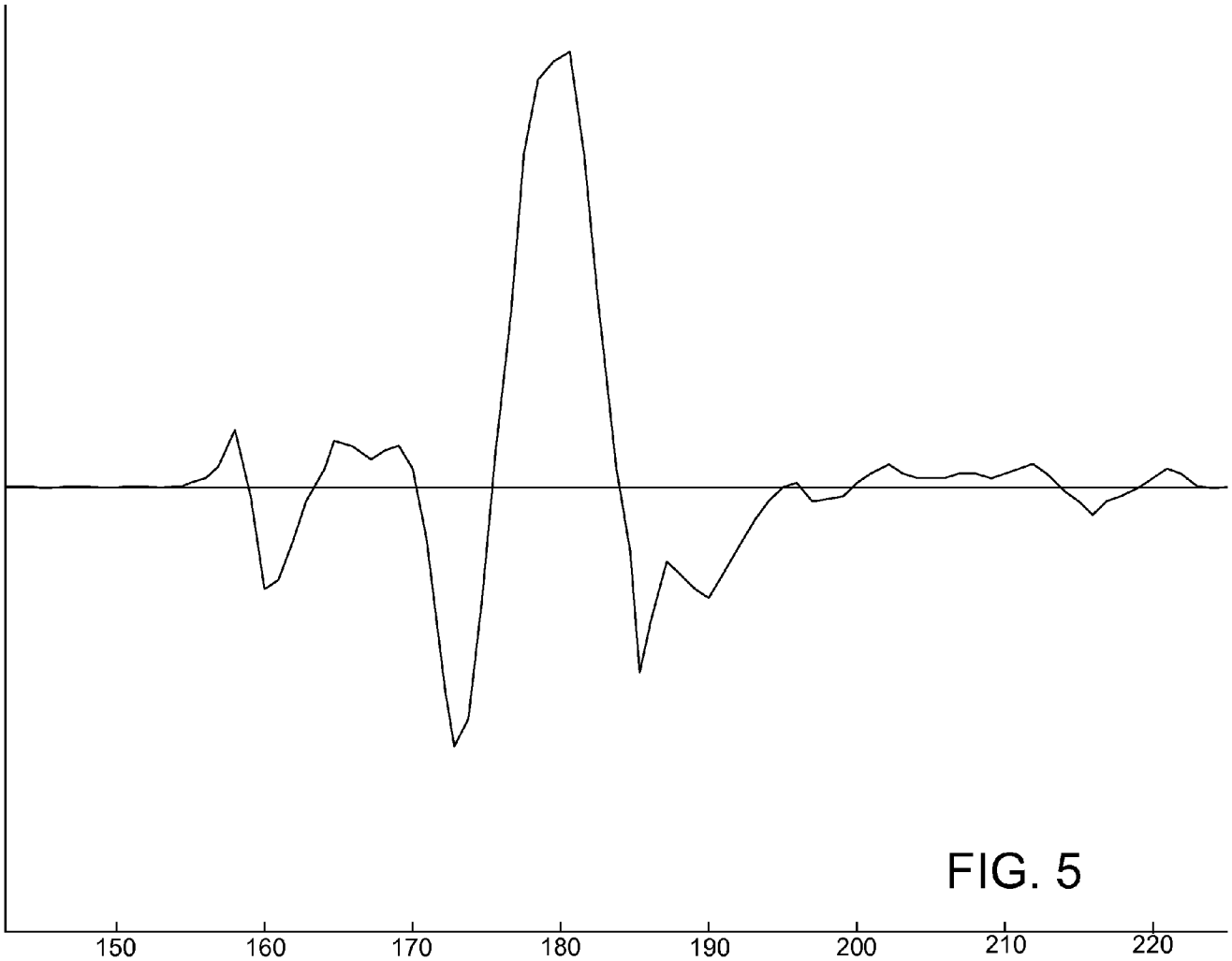
Figure 6:
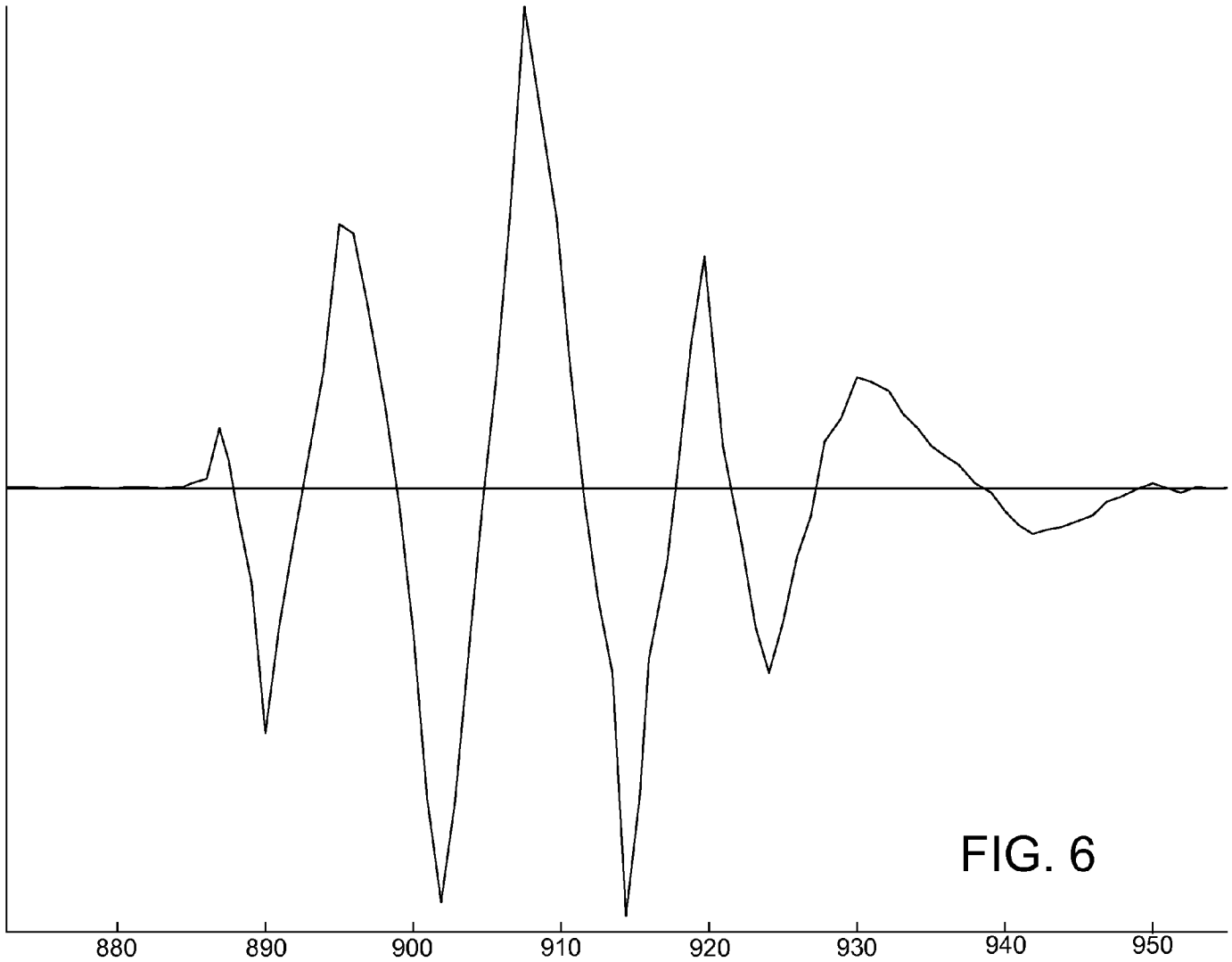
Figure 7:
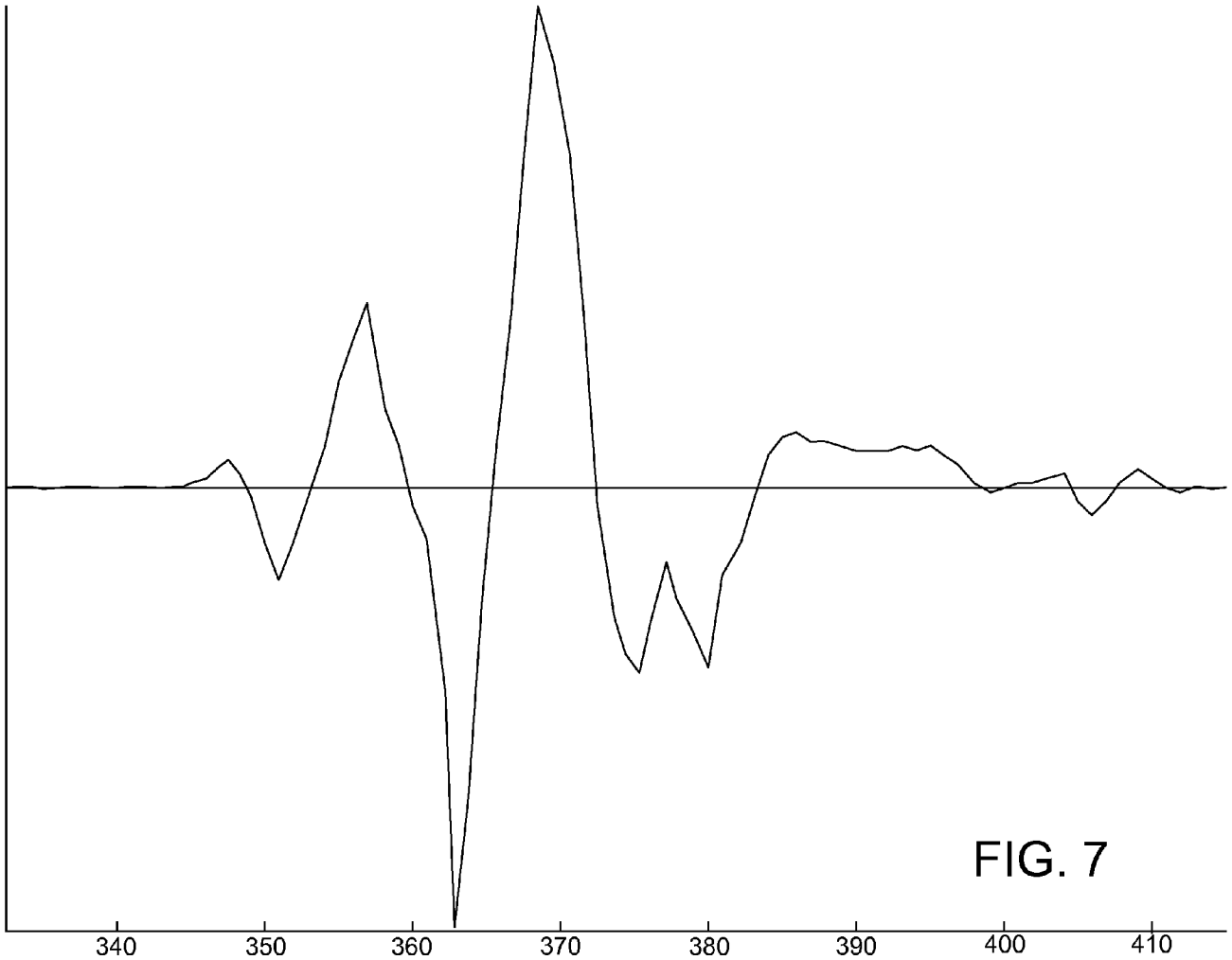

FIG. 3 shows a typical voltage signal from an acoustic input signal which included primarily only conversation in a room. For conversation level speech, the signal shown corresponds with about 60 to 70 dB SPL. The vertical axis scale shown in FIGS. 3-10 and 13 is much higher than the speech contribution to the signal level, so much so that the speech signal almost doesn't show up (except for the magnified portion of the signal). In that FIG. 3 only shows about 70 ms, this represents part of a spoken syllable. Even when the vertical scale is magnified, with only a single value each millisecond being shown, the low pass speech signal does not appear to include easily recognizable (speech-like) portions. Background noise in the room (HVAC system fans, outside traffic noise, etc.) in the low pass frequency band 22*a* is typically at about the same sound pressure level as the conversational level speech or lower.

FIGS. 4-7 and 13 show example signals witnessed in the low pass band 22*a* during a cupped pat event during conversation level speech, using an in-the-canal (but not sealing the canal 62) hearing aid 10. Rather than the 60 to 70 dB SPL witnessed by ordinary speech, the cupped pats 66 typically create a low frequency signal which is much greater in amplitude, such as 85 dB SPL or higher. In the preferred embodiment, the cupped pat signal has an amplitude which corresponds to 105 to 110 dB SPL, which is vastly higher than the low pass speech signal. Additionally, compared to a normal speech signal, a higher portion of the energy of the cupped pat 66 of the ear 64 is believed to be directed into the low frequency band 22*a* rather than the higher frequency bands 22.

Based upon a review of numerous cupped pat, low pass band signals such as those of FIGS. 4-7 and 13, several signature characteristics have been discerned. Firstly, the vast majority of the cupped pat low frequency energy occurs in a relatively short time frame, usually about $1/10^{th}$ of a second or less, and more commonly within about 50 ms. Secondly, during this short time period, the cupped pat energy within the low frequency band 22*a* is significantly higher than speech, music or than most background room sounds of interest. The preferred cupped pats 66 will generate at least one low pass signal peak from the microphone 12 which corresponds to an amplitude in excess of 85 dB SPL, and more commonly at least one low pass signal peak from the microphone 12 which corresponds to an amplitude in excess of 100 dB SPL. Thirdly, maximum amplitude is reached within only two to four positive peaks of the onset of the witnessed hand-pat event, i.e., typically within about 15-30 ms. Consecutive positive peaks, if present and significant, typically occur on the order of 10-20 ms apart. Fourthly, though not quite as rapid as onset, the majority of the low frequency energy dissipates relatively quickly, losing 75% or more (typically 90% or more) of its amplitude within only a few peaks, i.e., within 25-35 ms after the maximum amplitude is reached. The entire cupped pat signal has ten peaks or less, and most commonly one to five identifiable positive peaks.

As shown by the differences in FIGS. 4-7 and 13, the exact signal witnessed for any given hand pat event 66 will depend upon several factors, including the hand shape and ear geometry coupled together to make the low frequency "pop" and the location and force with which the hand 68 contacts the ear 64. While the signals reported in these figures were all generated by the same hearing aid 10, other hearing-aid-related factors, such as the location of the microphone 12 and the frequency and shape at which the low frequency band rolls off, etc., should also influence the exact results obtained.

In general terms, the same general signature characteristics will be witnessed across a wide variety of different people, all performing a cupped hand ear-pat 66 in different ways, using a wide variety of hearing aids in a wide variety of environmental acoustic situations. While the present invention uses the term "cupped" to refer generally to the hand shape which some wearers will use to create the signature compression wave event which activates the switch 56, the user's hand 68 need not necessarily be curved into a cup shape, so long as the act of striking the ear 64 creates the "popping" of air compression of sufficient magnitude to be identified as a switching event in the hearing aid 10. Most users will be familiar with this distinction in terms of the difference between clapping one's hands together and slapping one's hands together. For many wearers, the "clap" or "pop" can be created with two or more fingers pressed together in a "salute" hand shape, positioned so the two or more fingers line up to make contact all around the periphery of the concha bowl. Like clapping, it is very difficult to create the "clap" or "pop" with only a single finger. Alternatively, the "clap" or "pop" can be created by patting the open palm over the concha bowl. What is important is that the "clap" or "pop" is created, much more than the particular hand shape or hand position used to create the "clap" or "pop". Similarly, while the volume of the "clap" or "pop" sound needs to be above a threshold in order to switch, the existence of the "clap" or "pop" is more important than the force with which the ear 64 is struck; a soft tap or pat 66 which achieves the "clap" or "pop" can be identified more easily than a hard "slap", and much more easily than a slap which does not cover the concha bowl 60. Further, the volume of the "clap" or "pop" is only important as witnessed by the hearing aid, not by others in the room; the preferred signature hand motions 66 are sufficiently soft that they are largely or entirely unheard by anyone other than the hearing aid wearer.

The signature compression wave event shown in FIGS. 4-7 and 13 were all from the same in-the-ear hearing aid 10, which places the microphone 12 within the pocket of air used to create the "clap" sound. Behind-the-ear hearing aids, which would place the microphone 12 outside the pocket of air used to create the "clap" sound, may have somewhat different results.

Figure 8:
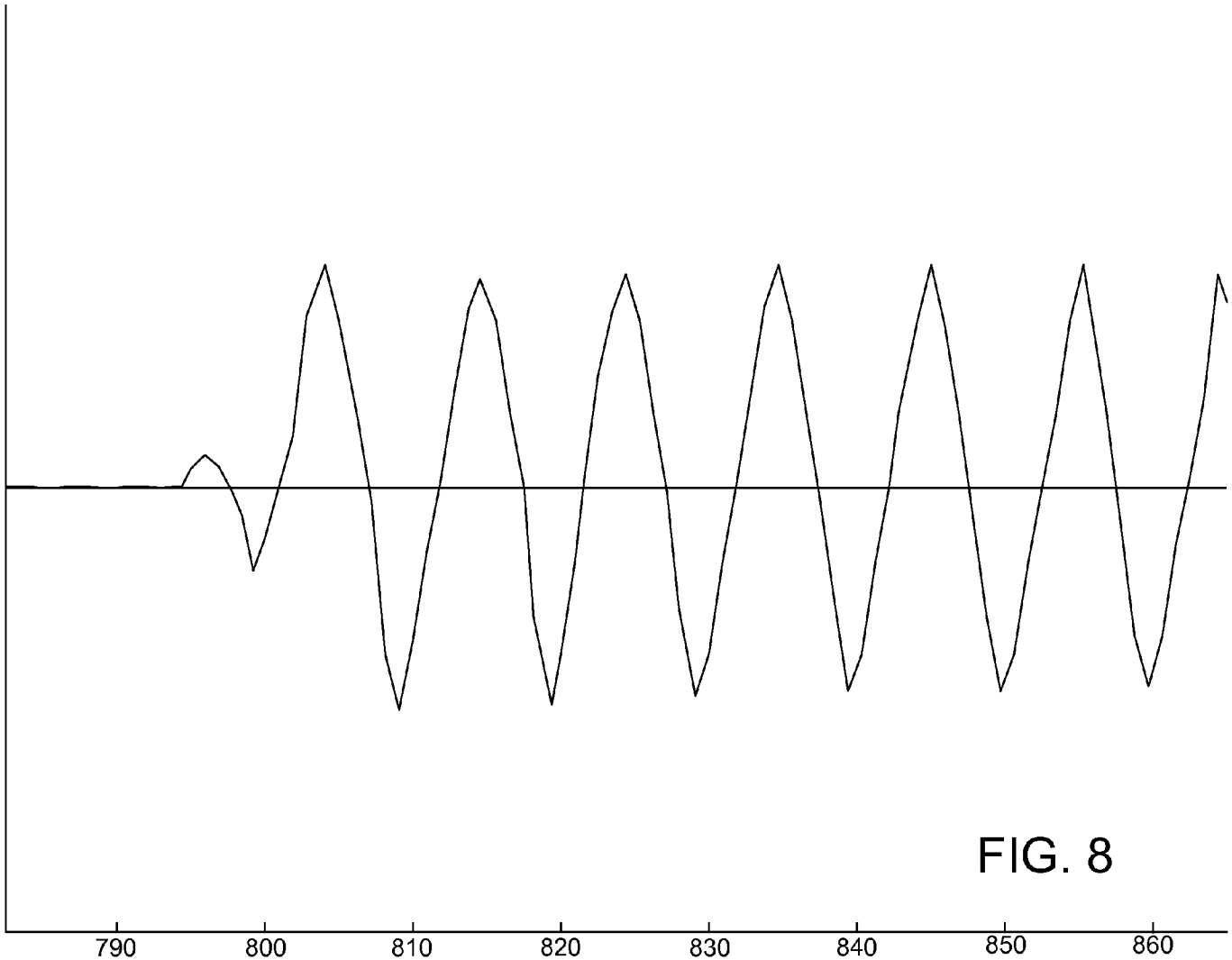
FIG. 8 shows an electrical signal in a low frequency channel in the hearing aid of FIG. 1 generated from a low frequency, high amplitude, pure tone acoustic input.

The distinguishing nature of the signature signal produced with the present invention is further seen when comparing what would otherwise be considered potential false positives, i.e., other sounds possibly encountered in daily life which could be misinterpreted as a switching hand movement. FIG. 8 shows the low frequency filtered signal witnessed for about a 105 dB SPL pure tone of 100 Hz (audible, but not ordinarily considered loud at that low frequency). This periodic signal, which might be encountered during music or an industrial noise environment, is readily distinguishable from the signature signal of the present invention. As one would expect, it bears a regular sine wave shape, with its magnitude and frequency relatively constant. Even though this signal is tuned to have consecutive positive peaks nearly at the same rate as the various positive peaks of FIGS. 4-7, there is nowhere near the correspondence in amplitudes and the rapid dissipation of energy shown in FIGS. 4-7. Music and pure tone signals, even signals of very low frequency and high sound pressure level, can accordingly be readily distinguished and do not create false positives.

Another type of potential false positive signal comes from wind noise. Wind noise can produce a large amplitude signal in the low pass range. However, similar to the much lower conversation signal shown in FIG. 3, wind noise is rarely completed over a short (less than 100 ms) time frame. Instead, wind noise typically exists within a hearing aid over a much longer time period.

Figure 9:
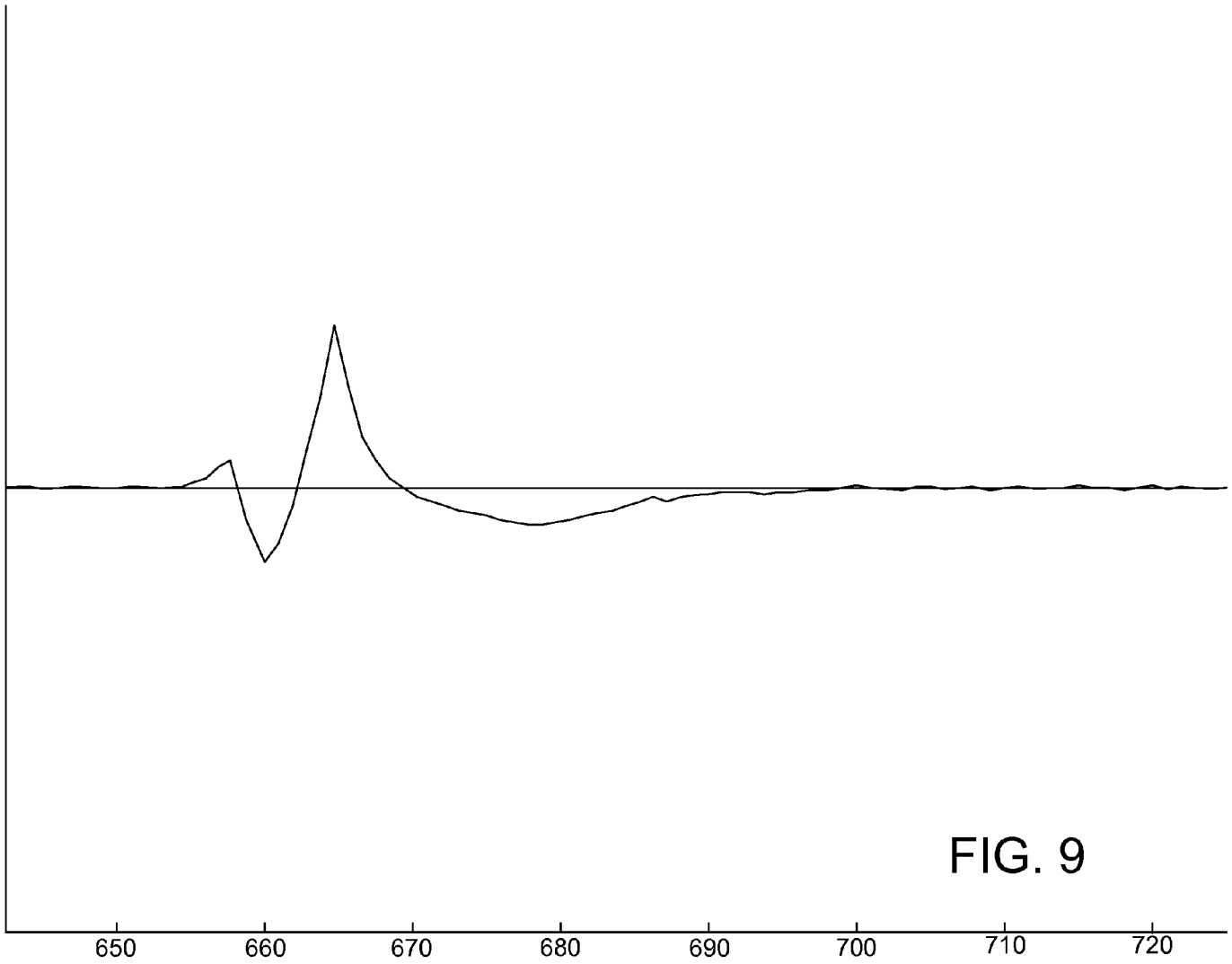
FIG. 9 shows an electrical signal in a low frequency channel in the hearing aid of FIG. 1 generated from a loud hand clap 8 to 10 inches away from a user's ear.
Figure 10:
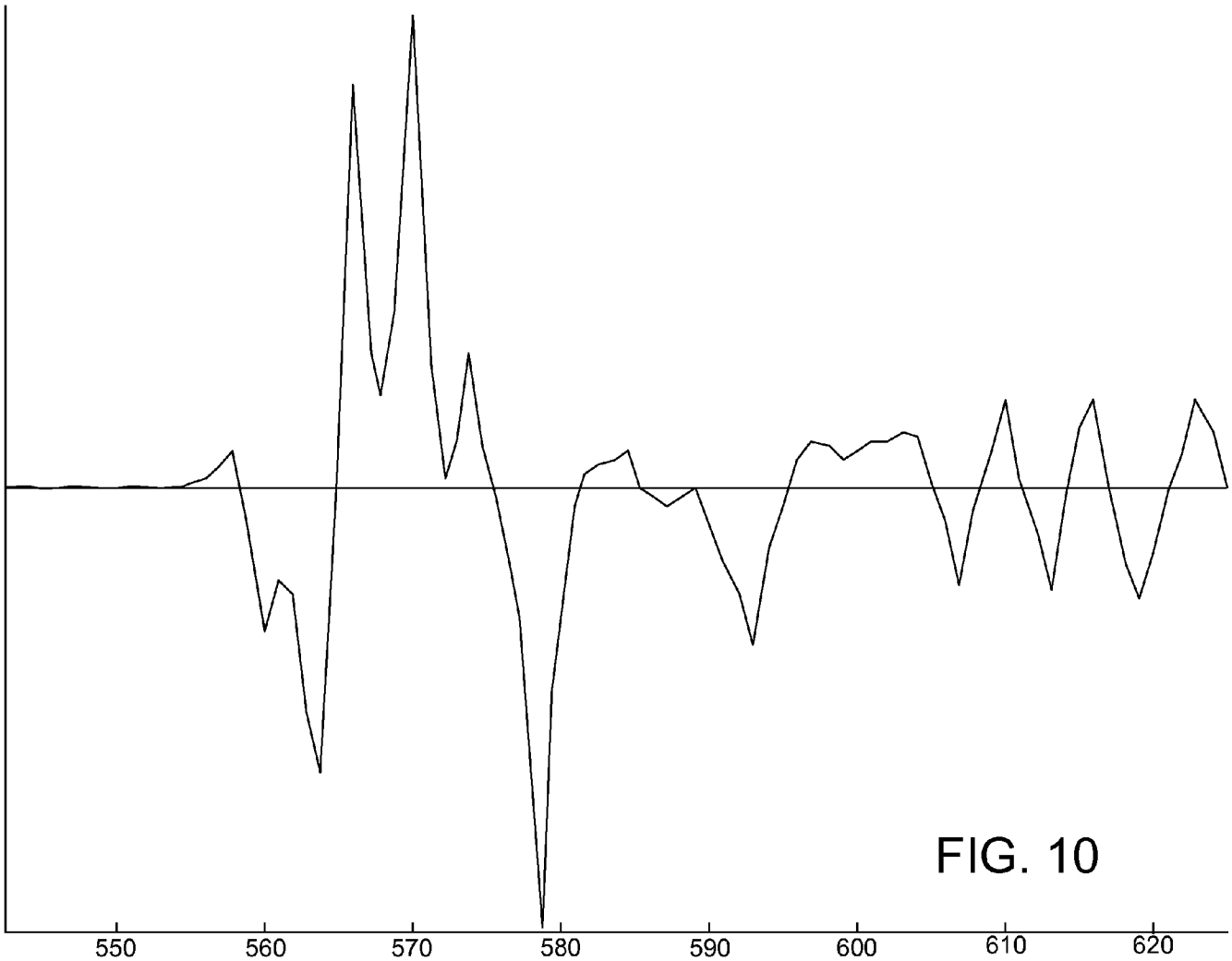
FIG. 10 shows an electrical signal in a low frequency channel in the hearing aid of FIG. 1 generated from slamming a thick book shut at a distance of 8 to 10 inches away from a user's ear.

FIGS. 9 and 10 shows the low frequency filtered signals witnessed from very different potential false positives. In the case of FIG. 9, the signal was created by having someone else clap as loudly as possible about 8-10 inches away from the user's ear with the hearing aid 10. In the case of FIG. 10, the signal was created by slamming a one-inch thick book shut, again as loudly as possible, about 8 inches away from the user's ear with the hearing aid 10. Either of these signals might be produced if someone was trying to startle the hearing aid user. In contrast to the acoustic signals of FIGS. 4-7 and 13, which were barely audible to other people in the room, the clapping was easily heard by everyone in the room, and the book slamming signal was shockingly loud to everyone in the room, almost like a gunshot. Despite being heard by everyone in the room, the signal from the clap of two hands was not of sufficient amplitude to trip the switch. With the perceived loud volume and general low frequency sound of the book slamming, the low pass book slamming signal shows more reverberation extending out over a longer time period than any of the cupped hand ear-pat signals. Another event which could create potential false positives similar to FIGS. 9 and 10 would be a compression event within the room, such as when a window or door slams shut, including when a car door slams shut. However, the vast majority of such compression events still include longer range reverberation similar to FIG. 10 rather than the quick energy dissipation shown in FIGS. 4-7 and 13.

Figure 11:
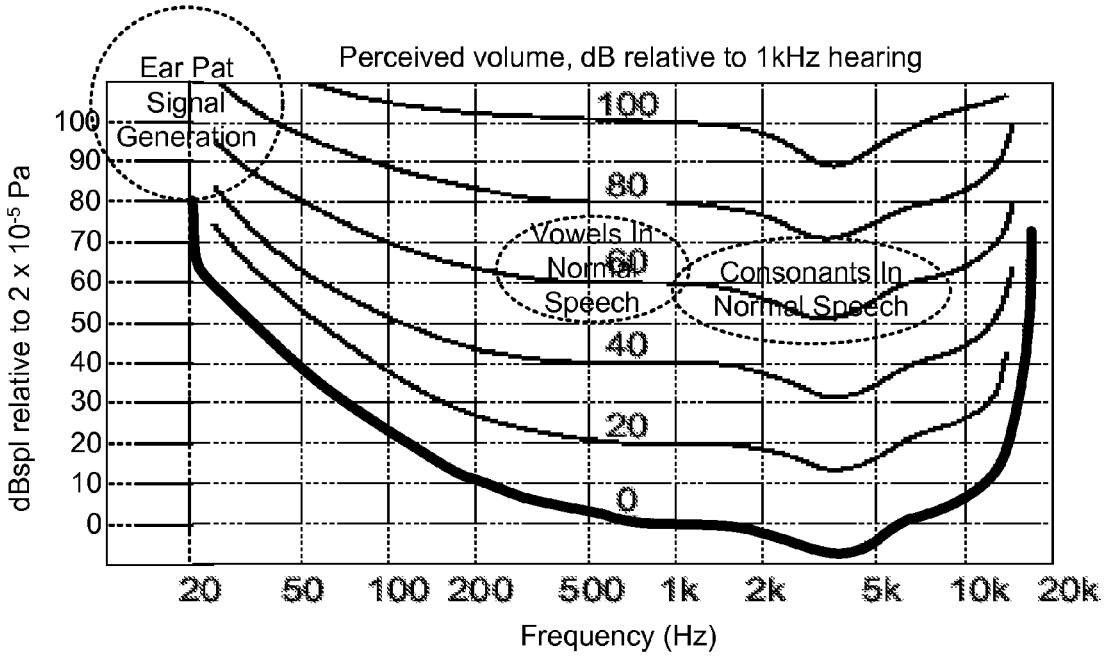
FIG. 11 shows the frequency perception of human hearing together with the frequencies of greatest interest from the preferred signature hand motion and from speech.

Further understanding of the nature of the signature characteristics of the cupped hand ear-pat event 66 is gained with reference to FIG. 11. FIG. 11 shows the frequency characteristics of "normal" human hearing of pure tones as published and widely known in audiology literature (a/k/a Fletcher-Munson curves). Though the fundamental frequencies of human voices are much lower (down to about 85 Hz), normal human hearing is most sensitive to sounds in the 2 to 5 kHz range. This 2 to 5 kHz range coincides with the energy of most importance in human speech (consonants and harmonics of lower pitches). Using the threshold of human hearing at 1 kHz as a 0 dB SPL benchmark, FIG. 10 then shows how normal human hearing tails off at different frequencies and volumes. Namely, while human hearing is generally considered to extend over the 20-20,000 Hz range, hearing acuity is not consistent or equal across this range. A 50 Hz pure tone at 40 dB SPL is barely audible to someone with the best hearing, despite having 100 times the power of a 2 kHz pure tone at 20 dB SPL which can be heard by people with normal hearing. Room conversation typically occurs at 60 to 70 dB. The witnessed cupped hand ear-pat low frequency filtered signals are in the 85 to 120 dB SPL range, i.e., in a range approaching that of a rock concert or jet engine, the whole range of which would be considered as requiring protection by OSHA regulations if it was for an extended time duration and in the speech frequency band. Despite providing this high energy level, the sound heard by the user when performing the cupped hand ear-pat is minimal and very tolerable, in large part because so much of its energy is in the low frequency levels. Put another way, the cupped hand ear-pat is "felt" by the user/hearing aid as much or more than it is "heard", but nonetheless is very identifiable in the low frequency filtered output of the microphone 12.

A further point of the cupped hand ear-pat involves the dissipation of sound energy as a function of travel distance. Namely, sound level is generally considered to drop about 6 dB each time the distance from the source of the sound doubles. The microphone 12 of the hearing aid 10 will be within an inch or two of the user's hand 68 where it contacts the ear 64, witnessing the sound/pressure wave in the 85 to 120 dB SPL range. Others in the room are typically 30-300 inches away, meaning that the SPL of those people from the cupped hand ear-pat will be 30 to 45 dB less than at the hearing aid 10. The user's hand 68 itself may further muffle this sound output. The low frequency energy created by the cupped hand ear-pat, though creating a dramatic signature in the low frequency filtered output of the hearing aid microphone 12, is not objectionable and seldom even heard by others in the room. The hearing aid user, by making a hand gesture which is less intrusive than trying to shoo away a fly, can generate a signature causing switching of the hearing aid 10.

Figure 12:
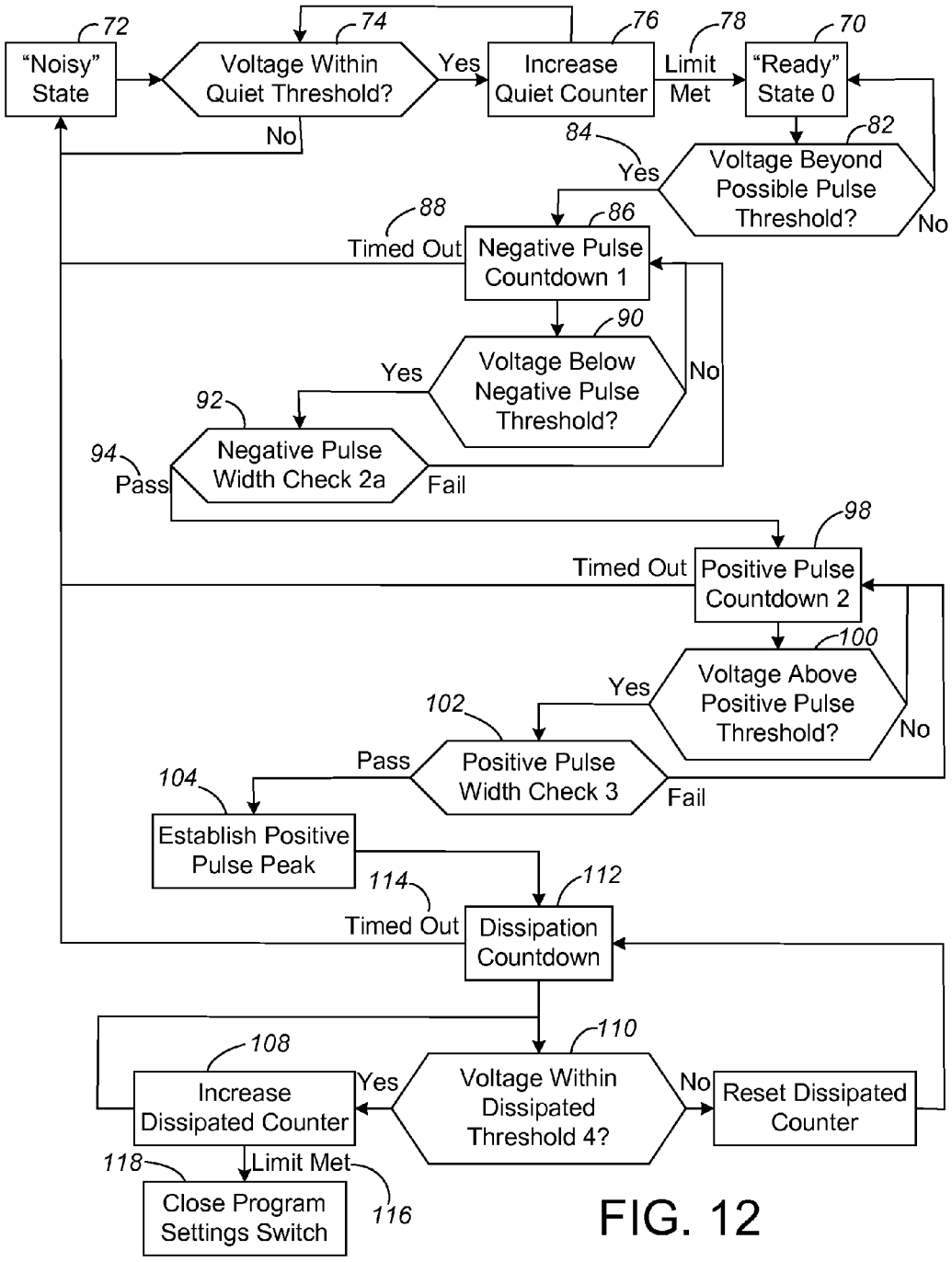
FIG. 12 shows a state block diagram of the preferred signature hand motion detection algorithm used in the hearing aid of FIG. 1.
Figure 13:
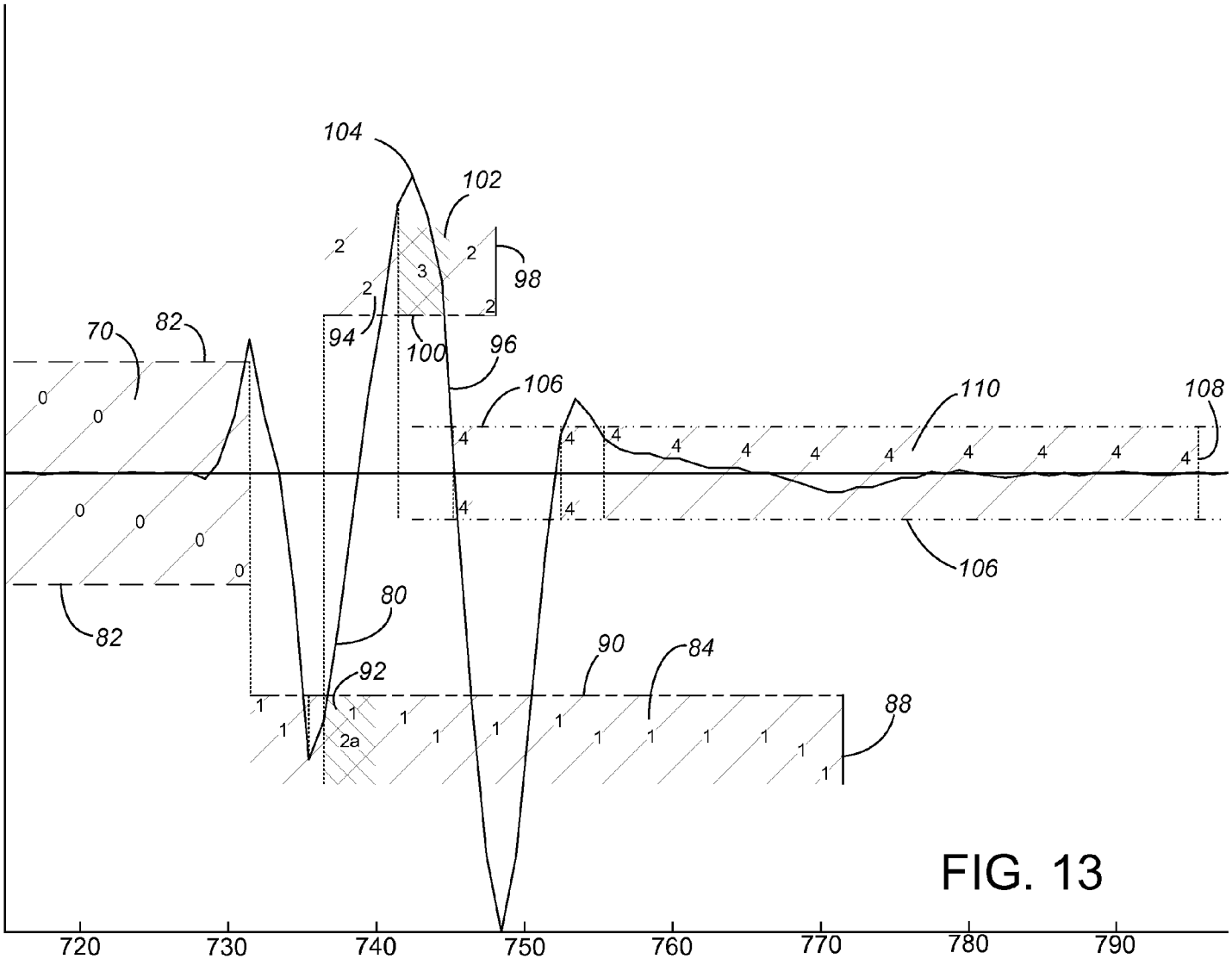
FIG. 13 show an electrical signal in a low frequency channel in the hearing aid of FIG. 1 generated from a preferred signature hand motion and mapping out the various states of the preferred signature hand motion detection algorithm of FIG. 12.

Further understanding of the preferred embodiment of the present invention is provided through the state diagram of FIG. 12 and the signal output plot of FIG. 13. FIGS. 12 and 13 represent a preferred signature pattern recognition algorithm for performing the present invention in the hearing aid 10. The coding for this signature pattern recognition algorithm resides on the DSP chip 21 in the hearing aid 10, and is preferably applied to a low frequency portion 22*a* of the digital signal. The preferred implementation and the signal 22*a* plotted in FIG. 13 was performed in the APT hearing aid available from IntriCon Corporation of Arden Hills, Minn. Because the DSP 21 in the APT hearing aid 10 already has the digital signal split into a 250 Hz and lower band 22*a*, this was the low frequency band used. The present invention could alternatively be used in a low frequency band having a different nominal range, or without any low frequency filtering at all if properly implemented.

As an initial step, the signature pattern recognition algorithm has a "ready" state 70, which generally occurs whenever the hearing aid 10 is in standard use without drastic signal changes. The cupped hand ear-pat detection algorithm can only begin from the "ready" state 70. As will be explained, starting the cupped hand ear-pat detection algorithm but failing to complete the switching will place the algorithm in a "noisy" state 72, from which it must time out through a time period of relative quiet before returning to the "ready" state 70. As long as conditions are within the quiet threshold 74, the quiet counter increases 76 until a quiet counter limit is met 78 and the algorithm returns to a "ready" state 70. In the current algorithm using the low frequency band 22*a* of the APT DSP 21, the test to leave the "noisy" state 72 and return to the "ready" state 70 is a time period of a 100 ms when the voltage of the low pass signal remains within normal levels, e.g., corresponding to an acoustic signal of less than about 97 dB SPL. During the vast majority of hearing aid use, the algorithm is in the "ready" state 70. However, certain events such as wind noise or the pure tone shown in FIG. 8, which occur on the order of seconds or more as opposed to completing within 50-100 ms, will keep the algorithm in the "noisy" state 72.

Assuming the algorithm is in the "ready" state 70, the algorithm begins by attempting to identify the first large negative pulse 80 of the cupped hand ear-pat event 66. The algorithm remains in the "ready" state 70 as long as the signal amplitudes are relatively quiet. In the current algorithm using the low frequency band 22*a* of the APT DSP 21, the algorithm remains in the "ready" state 70 until a positive or negative amplitude corresponding to over about 100 dB SPL is witnessed (|low pass signal|>100 dB). In the signal shown in FIG. 13, the algorithm was in the "ready" state 70 up to the value taken at 731 ms.

As soon as the signal exceeds this first possible pulse threshold 82, the first state 84 has been reached, and the algorithm starts looking for the large negative pulse 80, beginning a negative pulse countdown 86. In the current preferred algorithm using the low frequency band 22*a* of the APT DSP 21, the algorithm is looking for a negative pulse 80 corresponding to a sound pressure level equal to or greater than about 106 dB, which occurs within the time period 88 of no longer than 40 ms after reaching the first state 84. With the signal shown in FIG. 13 leaving the "ready" state 70 at 731 ms, the algorithm looks for the signal to pass the negative pulse threshold 90 some time during the duration between 731 and 771 ms. If, after reaching the first state 84, a negative pressure pulse 80 equal to or greater than this negative pulse threshold 90 is not witnessed before the negative pulse countdown 86 times out (i.e., not witnessed before 771 ms in this example), the algorithm proceeds to the "noisy" state 72. In the example of FIG. 13, the negative pressure pulse 80 was first identified at 735 ms.

If a negative pressure pulse 80 equal to or greater than the negative pulse threshold 90 is witnessed, the algorithm checks 92 to verify that the width of the negative pressure pulse 80 is sufficient. In general terms, the minimum width of the negative pressure pulse 80 requires some number of additional readings to be beyond the negative pulse threshold 90. The preferred algorithm thus includes a step 2*a* 92 searching for at least one additional voltage value corresponding to a sound pressure level beyond the negative pulse threshold 90. In the example of FIG. 13, the signal passed the negative pulse width check 92 at 736 ms.

If the observed negative pressure pulse 80 passes the negative pulse width check 92, then the algorithm leaves the first state 84 to the second state 94, searching for the high pressure pulse 96. Like when searching for the low pressure pulse 80, the high pressure pulse 96 must be witnessed within a certain duration of a positive pulse countdown 98. In the current preferred algorithm using the low frequency band 22*a* of the APT DSP 21, the algorithm is looking for a positive pulse 96 corresponding to a sound pressure level equal to or greater than about 102 dB, which occurs within the time period 98 of no longer than 11 ms after confirming 92 the negative pulse 80. In the example of FIG. 13, the signal passed the positive pulse threshold 100 at 742 ms.

If a positive pressure pulse 96 equal to or greater than the positive pulse threshold 100 is witnessed, the preferred algorithm checks 102 to verify that the width of the positive pressure pulse 96 is sufficient. Like the negative pulse width check 92, the minimum width of the positive pressure pulse 96 requires some number of additional readings to be beyond the positive pulse threshold 100. The preferred algorithm thus includes a step 3 102 searching for at least one additional voltage value corresponding to a sound pressure level above the positive pulse threshold 100. In the example of FIG. 13, the signal passed the positive pulse width check 102 at 743 ms.

Once the positive pulse width check 102 is passed, the next step is to establish the peak 104 of the positive pulse 96, which in the example of FIG. 13 occurred at 743 ms. Alternatively, the peak 102 could be defined as the greater of the first two readings above the positive pulse threshold 100. The peak 102 of the positive pulse 96 is used to determine the values for the dissipated threshold 106, which is preferably a percentage of the positive pulse peak value. In the preferred embodiment, the signal energy is considered dissipated when the value is 25% or less of the positive peak voltage. There are two timing aspects associated with the dissipated threshold 106. On one hand, the pulse is considered dissipated within the signature pattern recognition algorithm by having all values remain lower than the dissipated threshold 106 for a suitable verification duration 108. In one preferred embodiment, the suitable verification duration 108 is 40 ms. On the other hand, the signal must enter the dissipated region 4 110 within a relatively short dissipation countdown 112 after entering the fourth state 110. In one preferred embodiment, the dissipation countdown 112 is for 50 ms. If the signal enters the dissipated window 110 within 50 ms and then stays continually within the dissipated window 100 for the following 40 ms, the signal is considered to provide the signature of the cupped hand ear-pat 66. The algorithm then considers the program setting switch 56 "closed", changing to the next set of program settings 54. If the signal does not enter the dissipated window 110 within 50 ms and then stay continually within the dissipated window 100 for the following 40 ms, by no later than 90 ms after passing the positive pulse width check 102 the algorithm times out 114 and enters the "noisy" state 72.

Thus, the example signal of FIG. 13 first entered the dissipated region 110 at 743 ms, beginning the verification duration 108. However, the signal left the dissipated region 110 at 744 ms, i.e., before completing 40 ms within the dissipated threshold 106. The signal once again crossed the dissipated region 110 at 753 ms, but again exceeded the dissipated threshold 106 before completing 40 ms within the dissipated threshold 106. At 755 ms (which was still less than 50 ms after beginning step 4), the signal again came within the dissipated threshold 106, and this time the signal stayed within the dissipated window 110 continuously for the next 40 ms.

An alternative preferred method of looking for the quick dissipation of the signature signal is to define a time period window off the positive pressure pulse 96 when the signal must be within the dissipated window 110. For instance, the dissipated window 110 could be defined as the time period of 75 to 90 ms after passing the positive pulse width check 102. If the signal is within the dissipated window 110 throughout the 75 to 90 ms time window (and regardless of what the signal does prior to 75 ms after the high pressure pulse 96), the alternative algorithm is completed and considers the program setting switch 56 "closed".

Upon staying within the dissipated threshold 106 for the adequate duration 112 such that the limit of the dissipated counter is met 116, the signature pattern recognition algorithm has completed 118 its operation and considers the signal to have been created by the signature hand movement 66. The program settings 54 are indexed forward to the next group of settings. A tone is output on the hearing aid 10, which is audible to the hearing aid user but inaudible to others in the room, signifying to the user that the hand motion 66 was successful in switching the hearing aid 10.

The signature pattern recognition algorithm needs to complete switching of the hearing aid 10 within a reasonable period of time, no more than a few seconds, and preferably within less than one second after the signature hand motion 66. As can be seen in FIG. 13, the preferred signature pattern recognition algorithm was completed, based upon a single hand motion 66, within 65 ms after the user performed the signature hand motion 66. The preferred signature pattern recognition algorithm avoids both false positives and false negatives, and can be easily operated by a wide variety of people in a wide variety of situations. Users quickly learn that switching the hearing aid 10 with the preferred signature pattern recognition algorithm is much easier and more reliable than attempting to manipulate a physical switch on the hearing aid 10. Reinforced with the tone generated when the hearing aid 10 switches programs 54, users quickly become adept at learning the hand shape and how hard to strike their ear 64 in order to complete the most inconspicuous switching.

While the algorithm detailed here identifies the signature hand motion 66 to close the hearing aid switch 56, many changes could be made to the algorithm in accordance with the present invention, and should be changed based upon the hearing aid and conditions with which the algorithm is used. For instance, other hearing aids may set the various thresholds at other values and particularly at other values above 85 dB, and may set the various timers and counters for other durations. The key consideration is to devise a signature hand motion 66 relative to the user's ear 64 which, though effectively silent or unobtrusive to others in the room, creates a sufficiently distinctive signal so as to be identified in the particular hearing aid being used while avoiding both false positives and false negatives.

As a significant alternative to having the values for the first possible pulse threshold 82, the negative pulse threshold 90, and the positive pulse threshold 100 preset, one or all of these thresholds may have a value which is derived based upon the signal. When the signal demonstrates significant noise or volume, either in the low frequency band 22*a* or elsewhere, the thresholds used in the algorithm can be raised to higher values, and vice versa. When the wearer is in quiet surroundings, the switch 56 can be tripped by a very light cupped hand ear-pat 66. When the wearer is in noisier surroundings, the wearer is willing to make a louder cupped hand ear-pat 66 to trip the switch 56 without fear of disrupting others in the vicinity. Another alternative is to have the sensitivity of the various thresholds set during fitting of the hearing aid, when the particular user can practice the cupped hand ear-pat on his or her own ear and decide how sensitive the switch 56 should be.

Particularly if false positives become an issue for any particular hearing aid or hearing aid user, there are many ways to further modify the algorithm to avoid false positives. As one simple example, the user could be required to complete two or three cupped hand ear-pats, within a duration such as about one second of each other. A preferred multi-pat alternative involves assessing whether a second cupped hand ear-pat occurs within the time window of 100 to 700 ms after the first identified cupped hand ear-pat. The various thresholds of the multi-pat algorithm for identifying the second cupped hand ear-part can be set based upon the witnessed signal from the first cupped hand ear-part, such as requiring both ear pats to be of similar magnitude, requiring the second cupped hand ear-pat to be at higher magnitude than the first, or requiring the second cupped hand ear-pat to be at lower magnitude than the first. The multi-pat alternative is particularly beneficial if the user happens to have sound/pressure waves in their daily routine that mimic the signature created by a single ear-pat.

For instance, for some wearers with the hearing aid 10 in their left ear, slamming their car door shut could produce false positives, leading such users to prefer a multi-pat algorithm. Alternatively, the signature pattern recognition algorithm may be set up so that if there is one pat on the user's ear 64, the parameter setting 54 will change one way, whereas if there are two pats on the user's ear 64, the parameter setting 54 will change a different way. As another example, the introduction of the user's hand 68 adjacent the ear 64 changes the feedback characteristics in the FIR filter 42, and the FIR filter coefficients can be monitored to verify that the feedback characteristics have changed. By requiring the detection of both the abnormal change in the external feedback path 40 and the input signal generated by the abnormal magnitude of pressure, the device will be more robust and less prone to erroneous parameter setting switches. As a third example, the cupped hand ear-pat 66 could be combined with another distinctive hand motion that can be sensed by the hearing aid microphone 12, such as wiping one's hand 68 away from the ear 64 after completing the cupped hand ear-pat 66.

As an alternative or in conjunction with any of these previously described embodiments, it may be beneficial to perform analysis which is outside the low frequency band. While the most easily recognizable signature pattern from the cupped hand ear-pat 66 is believed to occur in the low frequency band, it likely has artifacts in other frequency bands, such as in the 250-500 Hz band. As significantly, other potential false positives likely have artifacts in other, higher frequency bands. If false positives or false negatives cannot be ruled out by easy analysis of the low frequency band, additional information from higher frequency bands can be used to obtain higher certainty in the switching decision.

All the embodiments of this invention perform the parameter switching normally done by a push button, without an actual physical push button. By obviating the need of a physical push button, the device size and cost can be reduced while improving reliability. Also the user actions that instigate the switching in this invention involve large hand motions. Therefore, there is no need for fine finger dexterity that may be difficult or inconvenient.

Although the present invention has been described with reference to preferred embodiments, workers skilled in the art will recognize that changes may be made in form and detail without departing from the spirit and scope of the invention.

What is claimed is:

1. A hearing aid comprising:

a microphone for changing an acoustic input into an electrical signal;

a digital signal processor for analyzing and adjusting the electrical signal; and a receiver which used the electrical signal output of the digital signal processor to produce a modified acoustic output;

wherein the digital signal processor comprises a switch for changing at least one parameter setting of the digital signal processor, the switch being controlled by an algorithm which analyzes the electrical signal for a signature hand motion of the user which creates a pressure wave sensed by the algorithm.

2. The hearing aid of claim 1, wherein the signature hand motion comprises a cupped hand ear-pat.

3. The hearing aid of claim 2, wherein the microphone is supported by a housing for positioning the microphone within the ear of a user.

4. The hearing aid of claim 2, wherein the signature hand motion comprises multiple cupped hand ear-pats.

5. A hearing aid comprising:

a microphone for changing an acoustic input into an electrical signal;

a digital signal processor for analyzing and adjusting the electrical signal; and a receiver which used the electrical signal output of the digital signal processor to produce a modified acoustic output;

wherein the digital signal processor comprises a switch for changing at least one parameter setting of the digital signal processor, the switch being controlled by an algorithm which analyzes the electrical signal for a signature hand motion of the user, wherein the digital signal processor splits the electrical signal into frequency bands, and wherein the algorithm analyzes a low frequency band to identify the signature hand motion of the user.

6. A hearing aid comprising:

a microphone for changing an acoustic input into an electrical signal;

a digital signal processor for analyzing and adjusting the electrical signal; and a receiver which used the electrical signal output of the digital signal processor to produce a modified acoustic output;

wherein the digital signal processor comprises a switch for changing at least one parameter setting of the digital signal processor, the switch being controlled by an algorithm which analyzes the electrical signal for a signature hand motion of the user, wherein the algorithm which analyzes the electrical signal for a signature hand motion of the user requires the signature hand motion to produce a pressure wave over 85 dB SPL.

7. The hearing aid of claim 6, wherein the algorithm which analyzes the electrical signal for a signature hand motion of the user requires a relatively quiet ready state prior to the pressure wave produced by the signature hand motion.

8. The hearing aid of claim 6, wherein the algorithm which analyzes the electrical signal for a signature hand motion of the user requires a dissipation of the magnitude of the pressure wave.

9. The hearing aid of claim 6, wherein the algorithm which analyzes the electrical signal for a signature hand motion of the user requires both a negative pressure peak and a positive pressure peak.

10. The hearing aid of claim 9, wherein the algorithm which analyzes the electrical signal for a signature hand motion of the user requires the negative pressure peak to exceed a first threshold, and requires a positive pressure peak to exceed a second threshold.

11. The hearing aid of claim 10, wherein the algorithm which analyzes the electrical signal for a signature hand motion of the user completes switching of the hearing aid within one second.

12. A method of switching at least one parameter setting of a digital signal processor of a hearing aid, comprising:

placing a hearing aid relative to the ear of a wearer, the hearing aid comprising:

a microphone for changing an acoustic input into an electrical signal;

a digital signal processor for analyzing and adjusting the electrical signal; and a receiver which used the electrical signal output of the digital signal processor to produce a modified acoustic output; and performing a signature hand motion relative to the ear with the hearing aid, the signature hand motion comprising contacting the ear meatus with the user's hand to create a pressure wave sensed by an algorithm running in the digital signal processor.

13. The method of claim 12, wherein the signature hand motion comprises a cupped hand ear-pat.

14. A method of switching at least one parameter setting of a digital signal processor of a hearing aid, comprising:

placing a hearing aid relative to the ear of a wearer, the hearing aid comprising:

a microphone for changing an acoustic input into an electrical signal;

a digital signal processor for analyzing and adjusting the electrical signal; and a receiver which used the electrical signal output of the digital signal processor to produce a modified acoustic output; and performing a signature hand motion relative to the ear with the hearing aid, the signature hand motion comprising contacting the ear meatus with the user's hand, wherein the digital signal processor splits the electrical signal into frequency bands, and wherein the digital signal processor performs an algorithm which analyzes a low frequency band to identify the signature hand motion of the user.

15. The hearing aid of claim 14, wherein the algorithm which analyzes the electrical signal for a signature hand motion of the user requires the signature hand motion to produce a pressure wave over 85 dB SPL.

16. The hearing aid of claim 15, wherein the signature hand motion is substantially inaudible to people other than the hearing aid wearer.

17. A method of switching at least one parameter setting of a digital signal processor of a hearing aid, comprising:

analyzing an electrical signal within the digital signal processor, the electrical signal being representative of at least some portion of sound received by a microphone of the hearing aid;

identifying a signal portion produced by signature hand motion relative to the ear with the hearing aid, the identified signal portion having at least a positive pressure pulse having an amplitude beyond a positive pressure pulse threshold and a negative pressure pulse having an amplitude beyond a negative pressure pulse threshold, and a dissipation region after both the positive pressure pulse and the negative pressure pulse wherein the identified signal portion is significantly less than the positive pressure pulse and the negative pressure pulse; and upon identification of the signal portion, switching at least one parameter setting of the digital signal processor of the hearing aid.

18. The method of claim 17, wherein the positive pressure pulse must occur within a defined duration after the negative pressure pulse.

19. The method of claim 17, wherein the positive pressure pulse threshold corresponds to a first sound pressure level value, and wherein the negative pressure pulse threshold corresponds to a second, different sound pressure level value.

20. The method of claim 17, further comprising splitting the electrical signal within the digital signal processor into frequency bands including at least one low frequency band, wherein the positive pressure pulse threshold and the negative pressure pulse threshold correspond to sound pressure level values over 85 dB.

21. The method of claim 17, further comprising determining a magnitude of the positive pressure pulse threshold and a magnitude of the negative pressure pulse threshold based upon the analyzed electrical signal.

* * * * *